US005199859A

United States Patent [19]

Kitaichi

[11] Patent Number: 5,199,859

[45] Date of Patent: Apr. 6, 1993

[54] REFRIGERANT COMPRESSOR

[75] Inventor: Shoichiro Kitaichi, Kanagawa, Japan

[73] Assignee: Kabushiki Kaisha Toshiba, Kanagawa, Japan

[21] Appl. No.: 701,890

[22] Filed: May 17, 1991

[30] Foreign Application Priority Data

May 17, 1990 [JP] Japan ..... 2-127600

[51] Int. Cl.[5] ..... F04B 39/12; F04C 29/02

[52] U.S. Cl. ..... 417/410 R; 418/179

[58] Field of Search ..... 418/179; 384/912; 417/410

[56] References Cited

U.S. PATENT DOCUMENTS 4,618,317 10/1986 Matsuzaki ..... 418/179

FOREIGN PATENT DOCUMENTS 450847 12/1991 European Pat. Off. ..... 418/179

300084 12/1989 Japan .

OTHER PUBLICATIONS

Preprint of the 34th Journal of Japan Society of Lubrication Engineers Conference, Y. Honma et al., 1989.

*Primary Examiner*—Leonard E. Smith

*Attorney, Agent, or Firm*—Oblon, Spivak, McClelland, Maier & Neustadt

[57] ABSTRACT

A compressing mechanism includes a slidable section which is constructed by combining a first slidable member made of a cast iron having a Vickers hardness within the range of 200 to 300 with a second slidable member made of a carbon steel having a Vickers hardness within the range of 200 to 300 and an average number of crystalline grains per 1 $mm^2$ within the range of 2000 to 3200. The slidable section is composed of a shaft and a bearing. Additionally, the slidable section includes a cylinder, a rotor and a piston. Each crystalline grain in the carbon steel constituting the second slidable member has a substantially isotropic shape and a size of the crystalline grain is suitably enlarged to exhibit a coarse structure. As a result, elasticity of the grain structure of the carbon steel is increased and a very small number of crystalline grains are peeled off from the surface of the substrate. Since the slidable section is constructed by combining the first slidable member with the second slidable member in the above-described manner, the second slidable member exhibits excellent wear resistance even under a circumstance wherein the 1,1,1,2-tetrafluoroethane or the 1,1-difluoroethane is used as a refrigerant in the presence of a polyether-based oil, a polyester-based oil or the like each serving as a refrigerator oil.

7 Claims, 9 Drawing Sheets

WORN LOCATION

WORN LOCATION

WORN LOCATION

MACROSTRUCTURE OF
COLD-ROLLED CARBON STEEL
(×400)

TABLE

MOISTURE ABSORBABILITY
OF VARIOUS KINDS OF LUBRICANTS (UNIT: ppm)

| NAME OF LUBRICANT / TIME | ESTER | POLYALKYLENE GLYCOL 1 | POLYALKYLENE GLYCOL 2 | POLYALKYLENE GLYCOL 2 + MINERAL OIL | ORDINARY MINERAL OIL |
|---|---|---|---|---|---|
| 0 | 109 | 335 | 352 | 211 | 29 |
| 24 | 1130 | 2763 | 4496 | 656 | 40 |
| 48 | 1380 | 4039 | 7031 | 1021 | 44 |
| 72 | 1433 | 4393 | 7771 | 1107 | 46 |
| 96 | 1502 | 4802 | 8233 | 1383 | 46 |

* NOTE: THE ABOVE FIGURES IN THE TABLE REPRESENTS A VALUE DERIVED FROM MEASUREMENT AT A TEMPERATURE OF 25 °C UNDER A MOISTURE OF 70%, RESPECTIVELY

REFRIGERANT COMPRESSOR

BACKGROUND OF THE INVENTION

1. Field of the Invention:

The present invention relates generally to a compressor for compressing a refrigerant. More particularly, the present invention relates to a refrigerant compressor in which 1,1,1,2-tetrafluoroethane or 1,1-difluoroethane is employed as the refrigerant.

2. Description of the related art:

Generally, a refrigerant compressor is used for an air conditioner, a refrigerator or the like so as to blow cool air or warm air into the interior of a room, a vehicle's cabin or the like. A hermetic refrigerant compressor and a semihermetic refrigerant compressor have been hitherto known as the refrigerant compressor, for a car air conditioner.

For example, the hermetic refrigerant rotary compressor includes a motor mechanism and a compressing mechanism which are arranged in a casing. The motor mechanism is operatively connected to the compressing mechanism via a shaft so that the compressing mechanism is driven by the motor mechanism via the shaft.

The compressing mechanism may, for example, include a cylinder and a roller eccentrically fixedly mounted on the shaft which is rotatably disposed in the cylinder. In addition, the compressing mechanism includes a blade which is protruded through the cylinder. One end of the blade is brought in slidable contact with the outer surface of the roller by the resilient force of a spring. The blade serves to divide the interior of the cylinder into a suction chamber and a discharge chamber. As the shaft is rotated, the roller repeatedly performs planetary movement to compress a refrigerant. The refrigerant which has been compressed is first discharged into the casing, and thereafter it is delivered to a refrigerator via a discharge tube. Slidable members such as a roller, a blade and so forth are constructed such that they smoothly move in the presence of a refrigerator oil which is received and stored in the casing. Things are the same with the shaft.

Dichloromethane (hereinafter referred to as CFC 12) and chlorodifluoromethane (hereinafter referred to as HCFC 22) have been mainly employed as the refrigerant in the refrigerant compressor. Further, a naphthene-based mineral oil and a paraffin-based oil each having solubility relative to the CFC 12 and the HCFC 22 have been employed as the refrigerator oil to be received in the compressing mechanism.

In recent years, it has been clarified that a flon discharged from each of the aforementioned refrigerants has serious effects on human beings as well as animals and plants. For this reason, it has been determined, on a global base, that employment of the CFC 12 and others, each having a high ozone depletion potential, is to be reduced year by year and employment of the aforementioned refrigerants will be prohibited in the future. In view of the foregoing circumstances, 1,1,1,2-tetrafluoroethane (hereinafter referred to as HFC 134a), 1,1-difluoroethane (hereinafter referred to as HFC 152a) and the like have been developed to be substituted for the CFC 12. In practice, the HFC 134a, the HFC 152a and the like have a low ozone depletion potential, respectively. However, they are hardly dissolved in the mineral oil which has heretofore been used as the refrigerator oil. For this reason, endeavors have been made to use a polyether-based oil, a polyester-based oil, a fluorine-based oil or the like, each having compatibility with HFC 134a and the HFC 152a when they are used as a refrigerant.

However, in the case where the HFC 134a or the HFC 152a is used as a refrigerant, to be substituted for the CFC 12 and, e.g., a polyether-based oil or a polyester-based oil is used as the refrigerator oil having solubility relative to the foregoing refrigerant, there arises a problem in that slidable members in the compressing mechanism or the like in the refrigerant compressor are greatly worn as the refrigerant compressor is operated. This problem leads to the result that the refrigerant compressor can not be stably operated for a long time.

Components in the refrigerant compressor which will be worn are classified into two groups, one of them being the shaft and associated components, and the other one being the blade, the roller (or the piston) and associated components. The shaft is rotated at a high rotational speed while it receives a spring force and a pressure in the cylinder via a roller and thereby it is slightly bent or curved due to slidable contact with a frame and a bearing, each serving to rotatably support the shaft. Consequently, the outer surface of the shaft and the inner surface of the bearing are unavoidably worn as the refrigerant compressor is driven. On the other hand, the blade rubs against the inner surface of a through aperture formed in the cylinder, due to the differential pressure between the two divided chambers in the cylinder, causing both the blade and the cylinder to be worn. In addition, since the foremost end of the blade is normally squeezed against the roller by the resilient force of the spring, the outer surface of the roller is worn too.

To fabricate slidable members such as a shaft or the like, a cast iron (e.g., JIS FC 25 specified in accordance with Japanese Industrial Standard (hereinafter referred to simply as FC 25)), a carbon steel (e.g., S12C, S15C or the like), a carbon steel for cold heading and cold forging (e.g., SWRCH 10A, SWCH 15A or the like), a carbon steel for machine structural use (SCM 435H or the like), a stainless steel, a sintered alloy and similar metallic materials have heretofore been used. However, it has been found that the carbon steel and others are greatly worn as the refrigerant compressor is operated with the use of the refrigerant and the refrigerator oil as mentioned above. Once the slidable members in the refrigerant compressor are worn, the ability to compress the refrigerant is degraded. As a result, it becomes difficult to operate the refrigerant compressor properly.

It is considered that wear of the slidable members is caused for the following reasons.

Specifically, in the case where CFC 12 is used as refrigerant, chlorine atoms in the CFC 12 react with iron atoms in each slidable member to thereby form a film of iron chloride having excellent wear resistance. In contrast with the CFC 12, in the case where HFC 134a is used as the refrigerant, since the HFC 134a contains no chlorine atom, a film of lubricant, such as the film of iron chloride, is not formed due to the absence of chlorine atoms, resulting in the lubricating function being deteriorated. On the other hand, since a conventional mineral oil-based refrigerator oil contains a cyclic compound, it has a comparatively high ability of forming an oil film. On the contrary, since the refrigerator oil having compatibility with HFC 134a or HFC 152a is composed of a cyclic compound as a main substance, it can not maintain an oil film having a certain adequate thickness under severe slidable conditions.

A carbon steel widely used as a material for slidable members is normally plastically processed in the form of a cold heading and has a Vickers hardness within the range of 300 to 500. After completion of the cold heading, the carbon steel has work hardness and exhibits a cold-rolled structure in which crystalline grains are elongated in the direction of working. FIG. 10 is a microscopic photograph which illustrates a macrostructure of the cold-rolled structure of the carbon steel on the surface of a cut piece thereof (refer to page 38 in the Section on steel materials in Collection Of Microscopic Photographs, 1979 edition, each illustrating a macrostructure of each of the steel material, edited by the Japan Metallic Material Association). In FIG. 10, the crystalline grains elongating in the direction of rolling with a white color represent a ferrite, and the crystalline grains remaining between the white crystalline grains while exhibiting a black color represent a perlite, respectively. Since the carbon steel having the aforementioned grain structure is forcibly pulled during a rolling operation, a residual stress remains within the carbon steel, causing the carbon steel to be kept in the thermally unstable state.

Therefore, the surface structure of a slidable member fabricated by using the carbon steel kept in the thermally unstable state is readily peeled off from the surface of the substrate for the above-described reasons, unless a film of lubricant is satisfactorily formed on the surface of the substrate of the carbon steel. Once peeling has occurred, grains peeled off therefrom act as burrs and scrape the surface of opposed slidable members. As a result, the wear loss of the carbon steel is increased.

In addition, HFC 134a, HFC 152a and the refrigerator oils compatible with them have high moisture absorbability. Since the refrigerant and the refrigerator oil normally recirculate through the casing, a film of lubricant on the surface of each slidable member is decomposed as the quantity of water in the refrigerant and the refrigerator oil increases. As a result, corrosive wear occurs with the slidable members. Indeed, the corrosive wear proceeds at an accelerated speed. Consequently, reduction of wear resistance of the slidable members is promoted.

Therefore, many requests have been received from users for improving wear resistance of the slidable members in the refrigerant compressor when HFC 134a or HFC 152a are employed as a new refrigerant, to be substituted for CFC 12, and a refrigerator oil having compatibility with the foregoing refrigerants are used in the refrigerant compressor. In addition, another important subject is to make it possible to operate the compressor for a long time by improving wear resistance of the slidable members.

SUMMARY OF THE INVENTION

The present invention has been made with the foregoing background in mind.

An object of the present invention is to provide a refrigerant compressor which makes it possible to stably operate the compressor for a long time by improving wear resistance of each of slidable members used to constitute a slidable section while 1,1,1,2-tetrafluoroethane or 1,1-difluoroethane is used as the refrigerant.

Another object of the present invention is to provide a method of fabricating a slidable member for a refrigerant compressor in which 1,1,1,2-tetrafluoroethane or 1,1-difluoroethane is used as the refrigerant while each slidable member is made of a carbon steel.

To accomplish the former object, the present invention provides a refrigerant compressor in which 1,1,1,2-tetrafluoroethane or 1,1-difluoroethane is used as the refrigerant, wherein the compressor includes a closed casing in which the refrigerant and a refrigerator oil having compatibility with the refrigerant are received, a compressing mechanism including a slidable section constructed by combining a first slidable member made of a cast iron having a Vickers hardness within the range of 200 to 300 with a second slidable member made of a carbon steel having a Vickers hardness within the range of 200 to 300 and an average number of crystalline grains per 1 $mm^2$ within the range of 2000 to 3200, the compressing mechanism being accommodated in the closed casing, and a motor mechanism for driving the compressing mechanism.

Since the slidable section in the compressing mechanism is constructed by combining the first slidable member with the second slidable member, a resistive force against heat generated by friction in the slidable section can substantially be enlarged even when a film of lubricant fails to be formed due to the presence of chlorine atoms or the oil film retaining power of a refrigerator oil is reduced undesirably.

Further, to accomplish the latter object, the present invention provides a method of fabricating a slidable member for a refrigerant compressor in which 1,1,1,2-tetrafluoroethane or 1,1-difluoroethane is used as the refrigerant, the slidable member being made of a carbon steel wherein the method includes a step of machining the carbon steel to assume a required configuration, a step of allowing the carbon steel which has been machined to the required configuration to be subjected to heat treatment at a temperature corresponding to a carbon content of the carbon steel so as to transform a grain structure of the carbon steel into a uniform austenite structure, and a step of gradually cooling the carbon steel after completion of the heat treatment so as to adjust the Vickers hardness of the carbon steel to remain within the range of 200 to 300 and adjust the average number of crystalline grains per 1 $mm^2$ to remain within the range of 2000 to 3200.

Other objects, features and advantages of the present invention will become apparent from reading the following description which has been made in conjunction with the accompanying drawings.

BRIEF DESCRIPTION OF THE DRAWINGS

The present invention is illustrated in the attached drawings in which.

DESCRIPTION OF THE PREFERRED EMBODIMENT

Now, the present invention will be described in detail hereinafter with reference to the accompanying drawings which illustrate a preferred embodiment of the present invention.

Figure 1:
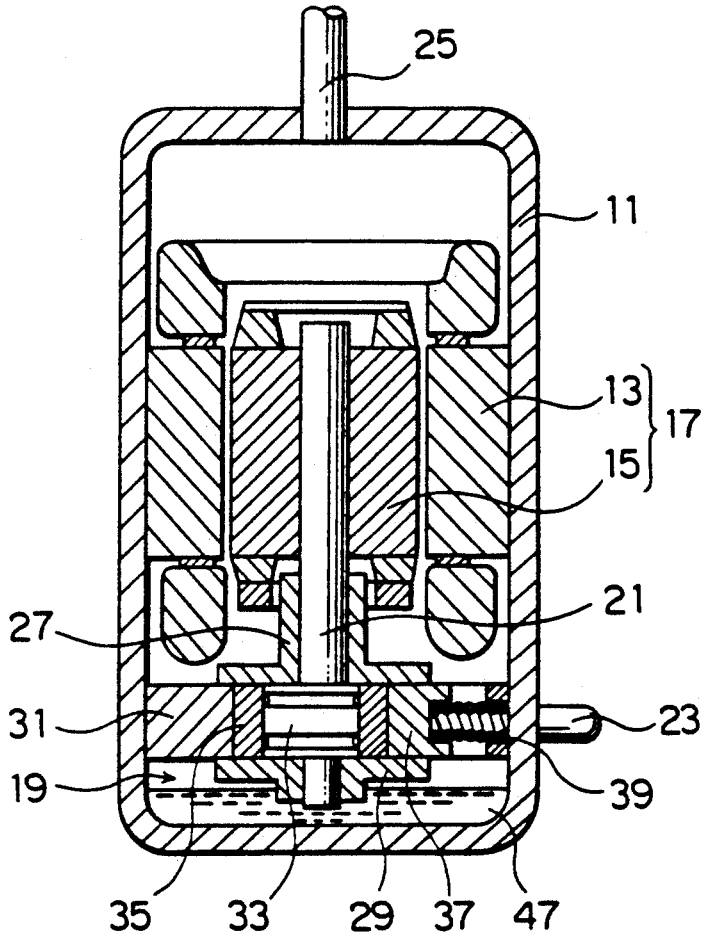
FIG. 1 is a vertical sectional view of a refrigerant compressor in accordance with an embodiment of the present invention.

FIG. 1 is a sectional view of a rotary-type refrigerant compressor in accordance with an embodiment of the present invention.

In the drawing, reference numeral 11 designates a closed casing. A motor mechanism 17 comprising a stator 13 and a rotor 15 is accommodated in the hermetic casing 11. In addition, a compressing mechanism 19 is arranged in the region below the motor mechanism 17 as seen in the drawing. The motor mechanism 17 and the compressing mechanism 19 are operatively connected to each other via a shaft 21. As a driving force is generated by the motor mechanism 17, it is transmitted to the compressing mechanism 19 via the shaft 21 to drive the compressing mechanism 19.

As the compressing mechanism 19 is driven, the refrigerant which has been introduced into the compressor via an accumulator (not shown) and a refrigerant supply tube 23 is compressed by the compressing mechanism 19. The compressed refrigerant is first delivered to the interior of the casing 11, and thereafter the compressed refrigerant is supplied to a refrigerator (not shown) via a discharge tube 25 which is fixedly fitted to the upper end of the casing 11.

To operate the compressor, 1,1,1,2-tetrafluoroethane (hereinafter referred to as a HFC 134a) or 1,1-difluoroethane (hereinafter referred to as a HFC 152a) is used as refrigerant. Since both refrigerants contain no chlorine atom, the ozone depletion potential of each of the refrigerants is zero. For this reason, they are preferably employed, from the viewpoint of protection of the environment. Although HFC 134a does not have a high energy efficiency, it has the advantage that a refrigerating system associated with the refrigerant compressor of the present invention can be replaced with the current refrigerating system. In addition, although HFC 152a is inflammable, it has the advantage that it has a very high energy efficiency.

Figure 2:
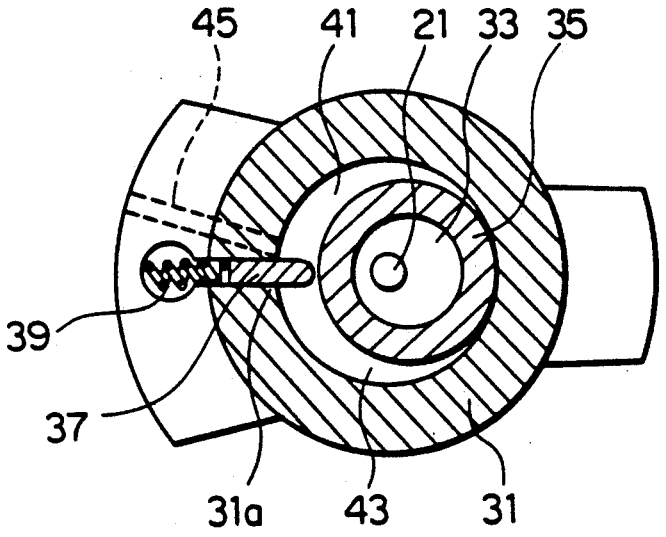
FIG. 2 is a cross-sectional view of a compressing mechanism in the compressor in FIG. 2.

The compressing mechanism 19 will be described in more details below with reference to FIG. 2.

The shaft 21, adapted to be rotated by the motor mechanism 17, is rotatably supported by a bearing fitted into a frame 27, and the lower end part of the shaft 21 is rotatably supported by a subbearing 29. The shaft 21 is arranged to extend through a cylinder 31. A crank portion 33 in the form of an eccentric is fixedly mounted on a part of the shaft 21 in the cylinder 31 and a roller 35 is fitted onto the crank portion 33 in the space between the crank portion 33 and the cylinder 31. As the shaft 21 is rotated, the roller 35 repeatedly performs planetary movement.

A movable blade 37 is protruded into the cylinder 31. The blade 37 is arranged in a through aperture 31*a* which is formed in the cylinder 31 so that the biasing force of a spring 39 is imparted to the blade 37. As the roller 35 performs planetary movement, the blade 37 moves reciprocably. One end of the blade, i.e., the right-hand end of the blade 37 as seen in FIG. 2 comes in slidable contact with the outer peripheral surface of the roller 35 while dividing the interior of the cylinder 31 into a suction chamber 41 and a discharge chamber 43. In response to planetary movement of the roller 35 caused as the shaft 21 is rotated, the refrigerant is sucked into the compressor via a suction port 45 so that it is compressed by the compressor.

A refrigerator oil 47 is received and reserved in the lower part of the casing 11. As the shaft 21 is rotated, the refrigerator oil 47 is sucked up by a pump (not shown) disposed at the lower end of the shaft 21 so as to lubricate slidable portions in the compressor.

It is required that a refrigerator oil having compatibility with the HFC 134a or the HFC 152a serving as a refrigerant is used so as to properly utilize the refrigerator oil 47 in the casing 11. This is because the refrigerator oil should reliably be returned to the compressor during a refrigerating cycle while preventing the refrigerator oil from remaining in the refrigerator. An ether-based oil, an ester-based oil, a fluorine-based oil or the like can be noted as a refrigerator oil having compatibility with HFC 134a and with HFC 152a. Among the aforementioned refrigerator oils, a polyalkylane glycol-based oil that is a kind of ether-based oil is preferably employable for HFC 134a and HFC 152a, because it has excellent properties of high viscosity and low flowability. It should be added that the ester-based oil is superior in respect of low moisture absorbability. Additionally, a mixture of the ether-based oil, a naphthene-based mineral oil, a paraffin-based mineral oil and an alkylbenzene may be employed.

The slidable portions in the compressor in accordance with the embodiment of the present invention, i.e., the slidable portions to be lubricated with one of the aforementioned refrigerator oils, will be noted below.

Since the shaft 21 receives the resilient force of the spring 38 and the pressure appearing in the cylinder 31, it is normally biased to come in close contact with the frame 27 and the subbearing 29, causing the shaft 21 to be rotated at a high rotational speed in the slightly bent or curved state. Therefore, the contact portions at which the outer surface of the shaft 21 comes in contact with the inner surfaces of the frame 27 and the subbearing 29 become a slidable portion, respectively. As the shaft 21 is rotated, the roller 35 is simultaneously rotated at a high rotational speed while coming in slidable contact with the inner wall surface of the cylinder 31. Similarly, the contact portion at which the roller 35 comes in slidable contact with the inner wall surface of the cylinder 31 becomes a slidable portion. Additionally, since the blade 37 rubs against the inner surface of the through aperture 31*a* in the cylinder 31 due to the differential pressure between the two divided chambers in the cylinder 31, the contact portion at which the blade 37 contacts the cylinder 31 becomes a slidable portion. Further, since the right-hand end of the blade 37 is squeezed against the roller 35 by the resilient force of the spring 39, the contact portion at which the blade 37 comes in slidable contact with the outer surface of the roller 35 becomes another slidable portion.

With respect to the compressor constructed in accordance with the embodiment of the present invention in the above-described manner, each of the aforementioned slidable portions is constituted by the combination of a first slidable member made of a cast iron having a Vickers hardness within the range of 200 to 300 and a second slidable member made of a carbon steel having a Vickers hardness within the range of 200 to 300 and an average number of crystalline grains per 1 $mm^2$ within the range of 2000 to 3200. For example, the shaft 21 is constituted by the first slidable member, and the frame 27 and the subbearing 29 are constituted by the second slidable member, respectively. In addition, the cylinder 31 is constituted by the first slidable member, and the roller 35 is constituted by the second slidable member.

Conditions associated with the first slidable member and the second slidable member are defined in the following manner. When the first slidable member, i.e., the cast iron has a Vickers hardness less than 200, it has an insufficient mechanical strength. When it has a Vickers hardness in excess of 300, the wear loss of the first slidable member greatly increases.

The carbon steel serving as the slidable member opposed to the first slidable member, i.e., the second slidable member, has a Vickers hardness within the range of 200 to 300 and an average number of crystalline grains per 1 $mm^2$ within the range of 2000 to 3200. When the carbon steel has a Vickers hardness less than 200, it has an insufficient mechanical strength. When it has a Vickers hardness in excess of 300, the wear loss of the carbon steel greatly increases. In a case where the carbon steel having a hardness within the aforementioned range has an average number of crystalline grains per 1 $mm^2$ within the range of 2000 to 3200, each of the crystalline grains in the carbon steel exhibits a coarse structure which is enlarged in the substantially isotropic state. This leads to the result that elasticity of the grain structure itself increases and wear resistance of the same is improved remarkably. In a case where the carbon steel has the number of crystalline grains per 1 $mm^2$ less than 2000, each of crystalline grains becomes excessively coarse, resulting in the mechanical strength of the carbon steel being undesirably reduced. When an average number of crystalline particles exceeds 3200, each crystalline grain becomes smaller in size and exhibits a distorted slender shape having no isotropy. This leads to the result that some crystalline grains are peeled off from the surface of the substrate due to heat generated during sliding movement of the relevant components and the peeled grains damage or injure the opposed slidable member with an enlarged wear loss.

Incidentally, it is assumed that the average number of crystalline grains referred to throughout the specification of the present invention represents a value which is derived from steps of sufficiently grinding the cut plane of a slidable member taken in the perpendicular direction relative to the direction of slidable movement of the slidable member, etching the cut plane using a nitric acid solution, visually counting the number of crystalline grains by visually observing the etched surface of the cut plane with the aid of a microscope having a magnification of 400 and finally converting the counted number into a number per 1 $mm^2$.

It is desirable that materials employable for the first slidable member and the second slidable member are selectively determined such that the hardness of the first slidable member is slightly higher than that of the second slidable member and that both slidable members are practically used by combining them with each other. This leads to an advantageous effect that wear resistance of the refrigerant compressor is substantially improved by combinative employment of both slidable members.

Figures 11, 12:
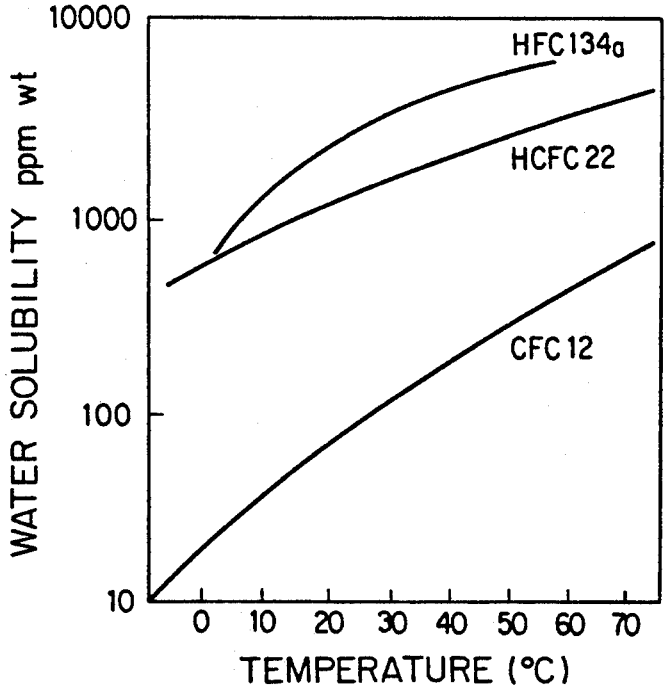
FIG. 11 is a table which illustrates moisture absorbability of various kinds of lubricants.
FIG. 12 is a diagram which illustrates water-solubility of various kinds of refrigerants.

The reason why excellent wear resistance can be obtained by combining the first slidable member and the second slidable member with each other in the above-described manner will be described below. As already mentioned above, HFC 134a and HFC 152a each have high water solubility. Since a refrigerator oil having compatibility to with HFC 134a and HFC 152a, e.g., a polyether-based oil, a ployester-based oil or the like has an intense polar group, its moisture absorbability is increased very largely. This fact is evidenced by the table and a graph shown in FIG. 11 and FIG. 12 respectively. If a considerably large quantity of water is contained in the refrigerant or the refrigerator oil, a film of lubricant on the surface of each slidable member is decomposed and thereby corrosive wear of the slidable members is enhanced with an accelerated speed of decomposition. It should be added that no lubricant film is formed due to the presence of chlorine atoms and the refrigerator oil has a low oil film retaining force. With respect to the compressor for which the HFC 134a or the HFC 152a is used as a refrigerant and a refrigerator oil having compatibility to these cooling mediums is employed in the above-described manner, each of the slidable members is subjected to severe operative conditions.

Generally, when a carbon steel is plastically worked, work hardness appears on the carbon steel and each crystalline grain exhibits a cold-rolled structure which elongates in the direction of working. The carbon steel having the cold-rolled structure has a high strength in the direction of cold-rolling but has a low strength in the direction at a right angle relative to the direction of cold-rolling. In addition, in view of the fact that each crystalline grain is distorted, a residual stress remains in the grain boundary with the result that each crystalline grain is kept in a thermally unstable state. In other words, the residual stress is readily released by heating and crystalline grains are easily peeled off from the surface of the substrate. Once peeling has occurred in this way, a part of the substrate having some crystalline grains removed therefrom rubs against an opposed slidable member, causing the wear loss to be enlarged. As the slidable members slidably move in the compressor, a temperature of each of the slidable members is elevated to in excess of 500° C. due to slidable contact between the components made of a metallic material and the grain structure of each slidable member near to the surface of the substrate is largely affected particularly in respect of wear resistance.

In contrast with this, the second slidable member employed for carrying out the present invention, i.e. a carbon steel, is metallurgically treated to have a Vickers hardness within the range of 200 to 300 and an average number of crystalline grains per 1 $mm^2$ within the range of 2000 to 3200. Each crystalline grain exhibits a substantially isotropic shape and a grain size of the crystalline grain is adequately enlarged to have a coarse grain structure. Thus, a residual stress does not substantially remain in the grain boundary including crystalline grains each having the aforementioned shape, whereby the carbon steel is kept in a thermally stable state. Additionally, elasticity of each crystalline grain itself is increased. This makes it possible to remarkably reduce the occurrence of peeling on the surface of the substrate of the carbon steel.

According to the present invention, each slidable portion is constituted by combining the second slidable member with a cast iron adapted to exhibit a self-lubricating function in the presence of a suitable hardness, i.e., the first slidable member. Therefore, a magnitude of resistive force against heat generated by frictional movement in the slidable portion is enlarged even under the severe condition that a lubricant film of refrigerator oil fails to be formed satisfactorily, and moreover excellent wear resistance is obtainable. Consequently, the refrigerant compressor of the present invention can stably be used for a long time by substantially improving wear resistance in each slidable portion under the aforementioned operative conditions.

A cast iron (to serve as a first slidable member) employed for carrying out the present invention while having a Vickers hardness within the range of 200 to 300 can be obtained by properly adjusting the carbon content or the silicon content. This is generally attributable to the fact that a hardness of the cast iron varies depending on the relationship that a content of graphite is increased and a hardness is reduced as an eutectic value Sc represented by the following equation is enlarged more and more.

$$Sc = C\,\% \,/\, (4.23 - \tfrac{1}{3}\,(Si\,\% + P\,\%))$$

In addition, since the hardness of the second slidable member (carbon steel) and the form and size of each crystalline grain can be controlled depending on heat treatment conditions after completion of a working operation, the required hardness, form and size can be obtained by employing a method which will be described below.

After completion of a cold heading and cold forging the carbon steel is annealed at a suitable temperature corresponding to a carbon content thereof. Not only to soften the hardened carbon steel but also to eliminate the influence derived from the cold heading and cold forging, from the viewpoint of a grain structure, it is required that the carbon steel be heated to an elevated temperature at which a uniform austenite structure appears and thereafter it is cooled gradually. In the case where dimensional variation occurs due to the aforementioned heat treatment, a machining operation is performed for the slidable members so as to allow them to assume final dimensions, as desired. In addition, in a case where heat treatment such as annealing or the like is given to the slidable members, each of them has a hardness represented by a Vickers hardness in excess of 300. Therefore, the crystalline grains in the carbon steel which have been distorted by a working operation can be corrected by heat treatment such as annealing or the like such that each crystalline grain has a Vickers hardness within the range of 200 to 300 and an average number of crystalline grains per 1 $mm^2$ within the range of 2000 to 3200 while exhibiting a substantially isotropic shape.

While the present invention has been described above with the respect to the hermetic refrigerant rotary compressor, it should, of course, be understood that the present invention should not be limited only to this. Alternatively, the present invention may equally be applied to various types of refrigerant compressors such as a semi-hermetic refrigerant compressor, a reciprocating-type refrigerant compressor or the like.

Next, description will be made below with respect to a few practical examples of the refrigerant compressor including a first slidable member and a second slidable member in the above-described manner as well as results derived from evaluation on the examples.

EXAMPLE 1

First, a first slidable member was prepared by machining a cast iron, JIS FC 25, specified by Japanese Standards Association (hereinafter referred to simply as FC 25), having a Vickers hardness of 280 to predetermined dimensions corresponding to a required shaft. On the other hand, a bearing serving as an opposed slidable member to the shaft was prepared using a carbon steel, JIS S15C, containing carbon in a quantity of 0.13% by weight (hereinafter referred to as S15C) by machining it to a predetermined shape. Then, the resultant bearing was subjected to heat treatment at an annealing temperature of 866° C. As a result, the bearing (second slidable member) made of a carbon steel having a Vickers hardness of 236 and an average number of crystalline grains of 2425 per 1 $mm^2$ was obtained by the foregoing heat treatment.

Figure 3A:
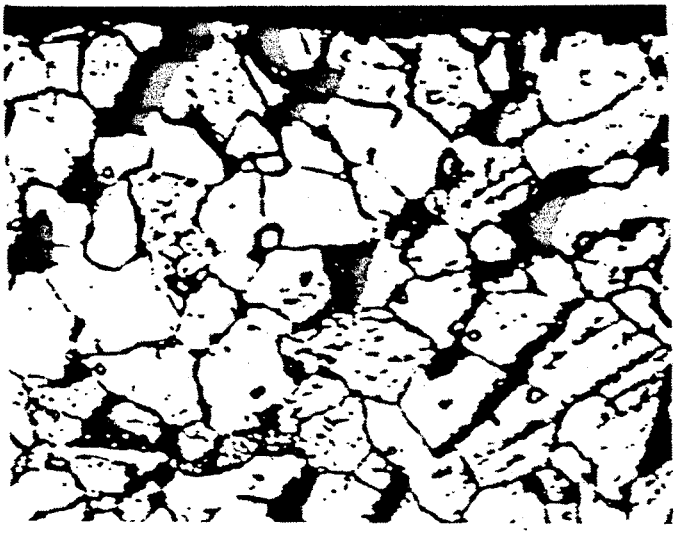
FIGS. 3(*a*) and 3(*b*) shows microscopic photographs each of which illustrates a macrostructure of a carbon steel employed for a bearing in the refrigerant compressor in accordance with an embodiment of the present invention.
Figure 3B:
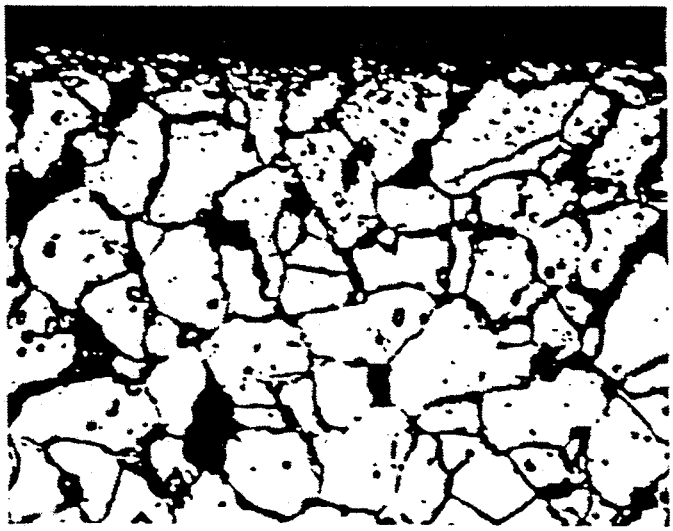

FIG. 3(*a*) is a microscopic photograph which shows the grain structure of the carbon steel on the surface of a cross section cut piece thereof. The microscopic photograph was obtained by visual observation with the aid of a microscope having a magnification of 400. This surface is a cut surface which was derived from a cutting performed in the direction at a right angle relative to the direction of slidable movement of the slidable member. The average number of crystalline grains was determined by counting the number of crystalline grains using the microscope having a magnification of 400 and then converting the value derived from the counting operation into a number per 1 $mm^2$. As is apparent from the microscopic photograph shown in FIG. 3(*a*), the carbon steel employed for this example is such that each crystalline grain has an isotropic shape and exhibits a coarse grain structure compared with a conventional carbon steel having a Vickers hardness in excess of 300.

The refrigerant compressor as shown in FIG. 1 was assembled by using the aforementioned slidable members. A polyester-based refrigerator oil was introduced into the compressor and HFC 134a was used as the refrigerant. Then, the compressor was operated for 500 hours. After operation of the compressor was completed, the outer surface of the shaft was visually observed with the aid of a scanning electron microscope. As a result, a trace of wear was hardly recognized on the outer surface of the shaft.

Figure 6:
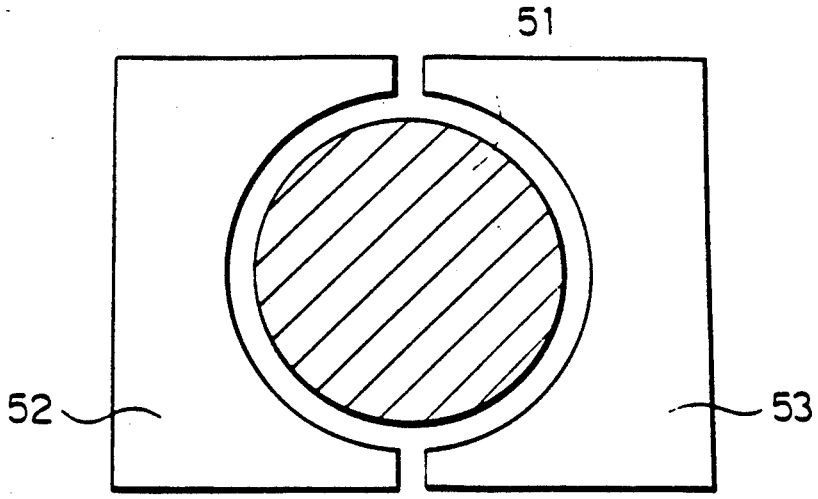
FIG. 6 is a schematic sectional view of a wear testing machine which is used for testing wear resistance of a shaft arranged in the refrigerant compressor of the present invention.

Additionally, wear resistance of the shaft was evaluated with the aid of a wear testing machine as schematically shown in FIG. 6. This machine is constructed such that a shaft 51 is clamped between V-shaped blocks 52 and 53, a load is set to a predetermined value by tightening the V-shaped blocks 52 and 53 and the shaft 51 is rotated while blowing a refrigerant toward the rotating shaft 51 so as to examine a quantity of wear within a predetermined period of time. In practice, a test was conducted such that the shaft 51 was made of a cast iron FC 25, and the V-shaped blocks 52 and 53 were made of the carbon steel which was prepared in accordance with Example 1 and the shaft 51 was rotated at a rotational speed of 290 rpm while blowing the HFC 134a toward the shaft 51.

It was confirmed from the results derived from the test that the shaft 51 was worn by a very small quantity of 2 mg and it had excellent wear resistance by combinative employment of the cast iron FC 25 having a Vickers hardness of 280 and the carbon steel having a Vickers hardness of 236 and an average number of crystalline grains of 2424 per 1 $mm^2$ FIG. 3(*b*) is a microscopic photograph which shows a macrostructure of the carbon steel on the surface of a cross section cut piece thereof after completion of the wear resistance test. A worn location is represented by an arrow mark in the drawing. As is apparent from this microscopic photograph, any significant difference can not be recognized between the macrostructure of the carbon steel before the test and the same after completion of the test.

EXAMPLE 2

A shaft having predetermined dimensions was prepared by performing a cutting using a cast iron FC 25 having a Vickers hardness of 280. On the other hand, a bearing having predetermined dimensions to serve as an opposed slidable member was prepared by performing a cutting using a carbon steel S15C (having a carbon content of 0.13% by weight) and the resultant bearing was subjected to heat treatment at an annealing temperature of 600° C. After completion of the heat treatment, it was found that the carbon steel constituting the bearing had a Vickers hardness of 288 and an average number of crystalline grains of 3154 per 1 $mm^2$ FIG. 4(*a*) is a microscopic photograph which shows a macrostructure of the carbon steel on the surface of a cross section cut piece thereof. A magnification of the microscopic photograph and a method of microscopically observing the macrostructure of the carbon steel are same as those in Example 1.

A refrigerant compressor as shown in FIG. 1 was assembled by using the aforementioned two slidable members. A polyalkylene glycol was introduced into the compressor as a refrigerator oil. Then, the refrigerant compressor was operated for 500 hours by using HFC 152a as the refrigerant. After operation of the compressor was completed, the surface of the shaft was visually observed with the aid of a scanning electron microscope. The result derived from the microscopic observation revealed that a trace of wear was hardly recognized.

Figure 4A:
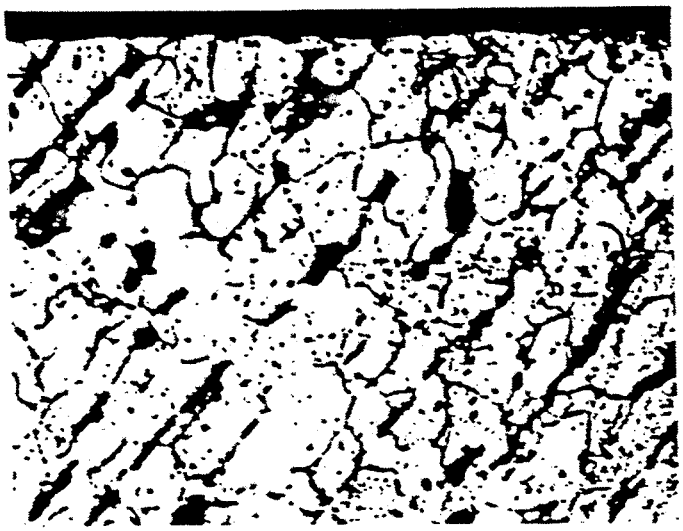
FIGS. 4(*a*) and 4(*b*) shows microscopic photographs each of which illustrates a macrostructure of a carbon steel for a bearing in a refrigerant compressor in accordance with another embodiment of the present invention.
Figure 4B:
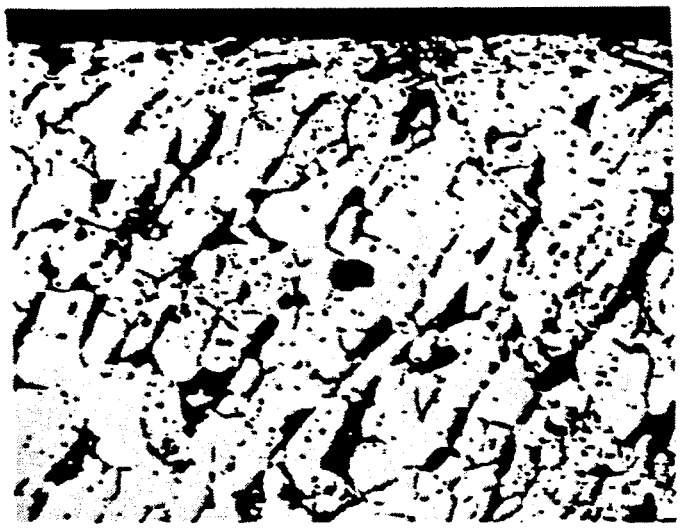

In addition, a wear resistance test was conducted in the same manner as in Example 1. It was confirmed from the result derived from the wear resistant test that a quantity of wear was a very small value of 2.9 mg by virtue of combinative employment of the cast iron FC 25 and the carbon steel S15C, and both slidable members had excellent wear resistance. FIG. 4(*b*) is a microscopic photograph which shows a macrostructure of the carbon steel on the surface of a cross section cut piece thereof.

EXAMPLE 3

A shaft having predetermined dimensions was prepared by performing a cutting using a cast iron FC 25 having a Vickers hardness of 240. On the other hand, a bearing having predetermined dimensions to serve as an opposed slidable member was prepared by performing a cutting using a carbon steel S15C (having a carbon content of 0.13% by weight). The resultant bearing was subjected to heat treatment at an annealing temperature of 866° C. After completion of the heat treatment, it was found that the carbon steel constituting the bearing had a Vickers hardness of 220 and an average number of crystalline grains of 2130 per 1 $mm^2$. The same refrigerant compressor as that in Example 1 was assembled by using the aforementioned two slidable members. A polyester-based oil was introduced into the refrigerant compressor as a refrigerator oil. Then, the refrigerant compressor was operated for 500 hours using HFC 134a as the refrigerant. After operation of the compressor was completed, the surface of the shaft was microscopically observed in the same manner as in Example 1. The result derived from the microscopic observation revealed that a trace of wear was hardly recognized. In addition, it was found from the result derived from an evaluation on a wear resistance test conducted for the shaft, that the shaft was worn by a very small quantity of 1.7 mg.

EXAMPLE 4

A shaft having predetermined dimensions was prepared by performing a cutting using a cast iron FC 25 having a Vickers hardness of 260. On the other hand, a bearing having predetermined dimensions to serve as an opposed slidable member was prepared by performing a cutting operation using a carbon steel S15C (having a carbon content of 0.13% by weight). The resultant bearing was subjected to heat treatment at an annealing temperature of 866° C. After completion of the heat treatment, it was found that the carbon steel constituting the bearing had a Vickers hardness of 250 and an average number of crystalline grains of 2600 per 1 $mm^2$. The same refrigerant compressor as that in Example 1 was assembled by using the aforementioned slidable members. A polyalkylene glycol was introduced into the refrigerant compressor as a refrigerator oil. Then, the refrigerant compressor was operated for 500 hours using HFC 152a as refrigerant. After operation of the refrigerant compressor was completed, the surface of the shaft was microscopically observed in the same manner as in Example 1. The result derived from the microscopic observation revealed that a trace of wear was hardly recognized. In addition, it was found from the result derived from an evaluation on a wear resistance test, conducted for the shaft, that the shaft was worn by a very small quantity of 2.2 mg.

COMPARATIVE EXAMPLE 1

Figure 5A:
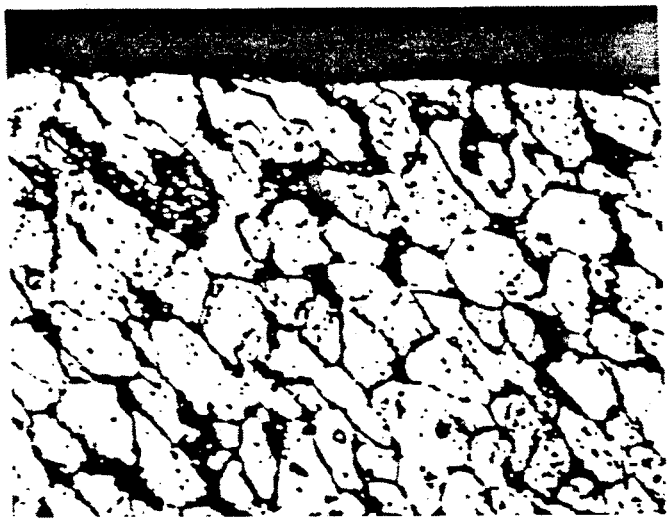
FIGS. 5(*a*) and 5(*b*) shows microscopic photographs each of which illustrates a macrostructure of a carbon steel for a bearing in a conventional refrigerant compressor.
Figure 5B:
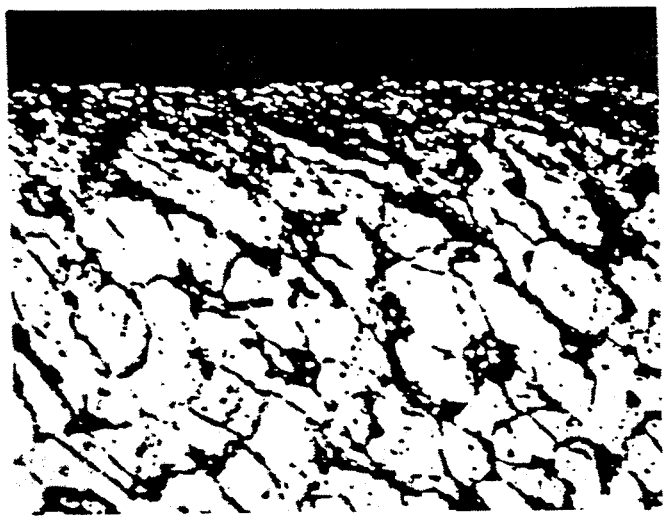

A shaft having predetermined dimensions was prepared by performing a cutting using a cast iron FC 25 having a Vickers hardness of 320. On the other hand, a bearing having predetermined dimensions to serve as an opposed slidable member was prepared by performing a cutting using a carbon steel S15C (having a carbon content of 0.13% by weight). No heat treatment was carried out for the bearing. It was found that the carbon steel constituting the bearing had a Vickers hardness of 310 and an average number of crystalline grains of 3636 per 1 $mm^2$. FIG. 5(*a*) is a microscopic photograph which shows a macrostructure of the carbon steel on the surface of a cross section cut piece thereof. This microscopic photograph was obtained by carrying out visual observation with the aid of an optical microscope having a magnification of 400 in the same manner as in Example 1. As is apparent from this microscopic photograph, the carbon steel having a Vickers hardness in excess of 300 and an average number of crystalline grains per 1 $mm^2$ in excess of 3200 has an elongated crystal form and a grain structure derived from a rolling operation.

A refrigerant compressor having the same structure as that in Example 1 was assembled by using the aforementioned slidable members. A polyester-based oil was introduced into the refrigerant compressor as a refrigerator oil. The refrigerant compressor was operated for 500 hours using HFC 134a as the refrigerant in the same manner as in Example 1. After operation of the refrigerant compressor was completed, the surface of the shaft was microscopically observed with the aid of a scanning electron microscope. The result derived from the microscopic observation revealed that a trace of wear caused by slidable movement of the slidable members was recognized clearly.

In addition, a wear resistance test was conducted for the shaft under the same conditions as those in Example 1 by operating the wear testing machine shown in FIG. 6 so as to evaluate wear resistance of the shaft. FIG. 5(*b*) is a microscopic photograph which shows a macrostructure of the carbon steel on the surface of a cross section cut piece thereof after completion of the wear resistance test. As is apparent from the microscopic photograph, the carbon steel had a Vickers hardness in excess of 300 and an average number of crystalline grains per 1 $mm^2$ in excess of 3200. It was found that the carbon steel was worn by a large quantity of 50 mg with combinative employment of the aforementioned slidable members, and moreover the refrigerant compressor can not practically be used for a long time.

COMPARATIVE EXAMPLE 2

A shaft having predetermined dimensions was prepared by performing a cutting using a cast iron FC 25 having a Vickers hardness of 150. On the other hand, a bearing serving as an opposed slidable member was prepared by performing a cutting using a carbon steel S15C (having a carbon content of 0.13% by weight). The resultant bearing was subjected to heat treatment at an annealing temperature of 950° C. After completion of the heat treatment, it was found that the carbon steel had a Vickers hardness of 170 and an average number of crystalline grains of 1550 per 1 $mm^2$.

A refrigerant compressor having the same structure as that in Example 1 was assembled by using the aforementioned slidable members. A polyester-based oil was introduced into the refrigerant compressor as a refrigerator oil. Then, the refrigerant compressor was operated for 500 hours using HFC 134a in the same manner as in Example 1. After operation of the refrigerant compressor was completed, it was found that each of the slidable members had a shortage of mechanical strength because of their low hardness and cracks were recognized on the shaft.

Figure 7:
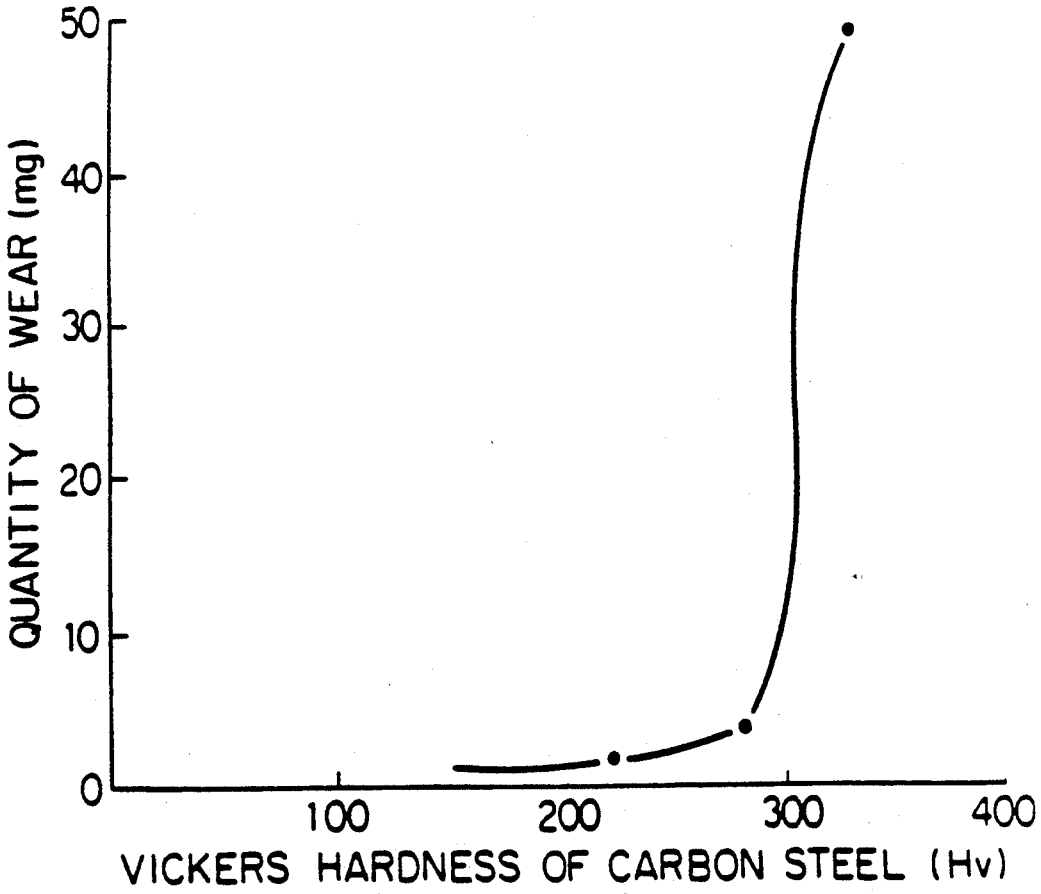
FIG. 7 is a diagram which illustrates a relationship between the Vickers hardness of a carbon steel and the quantity of wear of the carbon steel.
Figure 8:
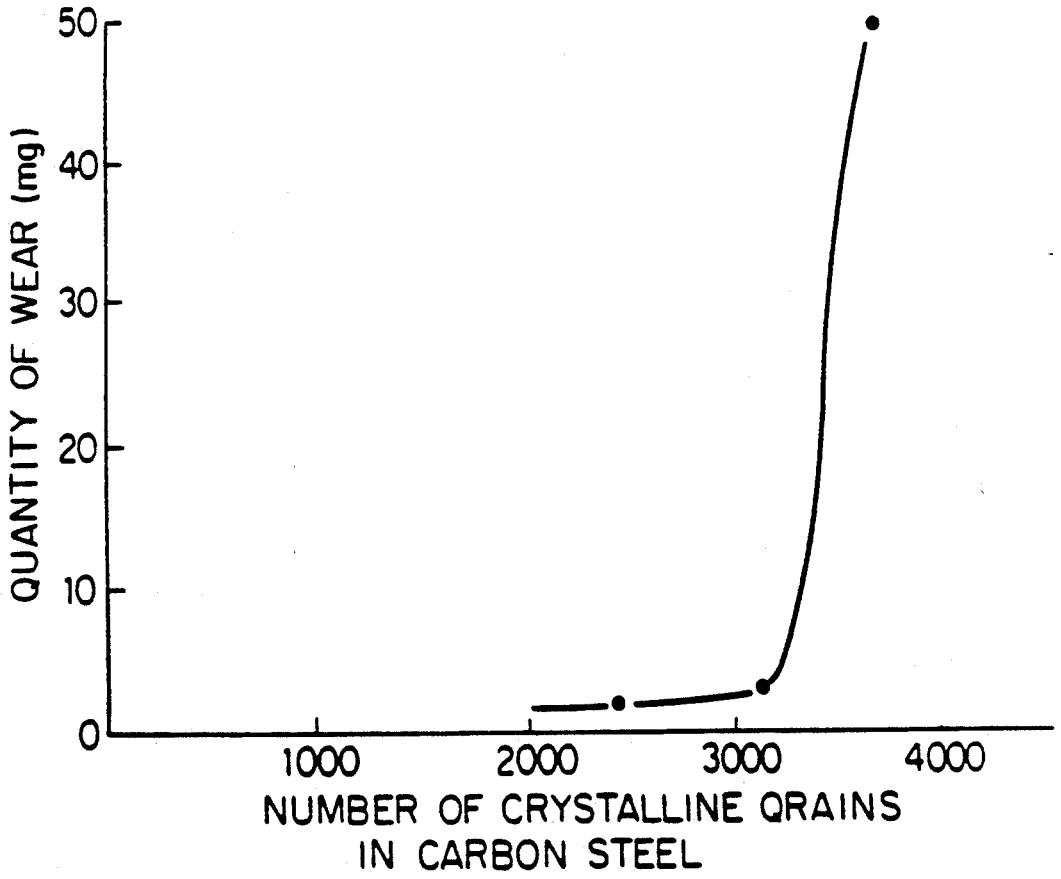
FIG. 8 is a diagram which illustrates a relationship between the number of crystalline grains in a carbon steel and the quantity of wear of the carbon steel.

FIG. 7 is a graph which illustrates the results derived from the Examples 1 to 4, and FIG. 8 is a graph which illustrates the results derived from the Comparative Examples 1 and 2. Specifically, FIG. 7 illustrates a relationship between a Vickers hardness and a quantity of wear with respect to the carbon steels employed for the Examples 1 to 4, and FIG. 8 illustrates a relationship between the number of crystalline grains and a quantity of wear with respect to the carbon steels employed for the Comparative Examples 1 and 2. It is apparent from the two graphs that a quantity of wear of each carbon steel is greatly increased in the region where a Vickers hardness exceeds 300 and that a quantity of wear of each carbon steel is rapidly increased in the region where the number of crystalline grains of each carbon steel exceeds 3200.

Consequently, the present invention makes it possible to substantially improve wear resistance of each of the slidable members by combining a cast iron having a Vickers hardness within the range of 200 to 300 with a carbon steel having a Vickers hardness within the range of 200 to 300 and an average number of crystalline grains per 1 $mm^2$ within the range of 2000 to 3200 to provide the slidable members. Additionally, the refrigerant compressor can practically be used for an elongated period of time by employing the slidable members as mentioned above.

Reference Example

Description will be made below with respect to wear resistance of slidable members employed for a conventional refrigerant compressor in which CFC 12 is used as the refrigerant.

To operate a refrigerating system having CFC 12 as refrigerant, a paraffin-based oil was introduced into the refrigerant compressor as a refrigerator oil, and an ordinary carbon steel (having a Vickers hardness of 306) and a cast iron (having a Vickers hardness of 278) were combinatively used to provide slidable members. Then, the refrigerant compressor was operated for 500 hours in the same manner as in Examples 1 to 4. After operation of the refrigerant compressor was completed, the surface of the shaft was microscopically observed with the aid of a microscope. It was found from the results derived from the microscopic observation that a trace of wear of the shaft was hardly recognized. In addition, it was found from the results derived from an evaluation on a wear resistance test conducted for the shaft that the shaft was worn by a small quantity of 5 mg.

Figure 9:
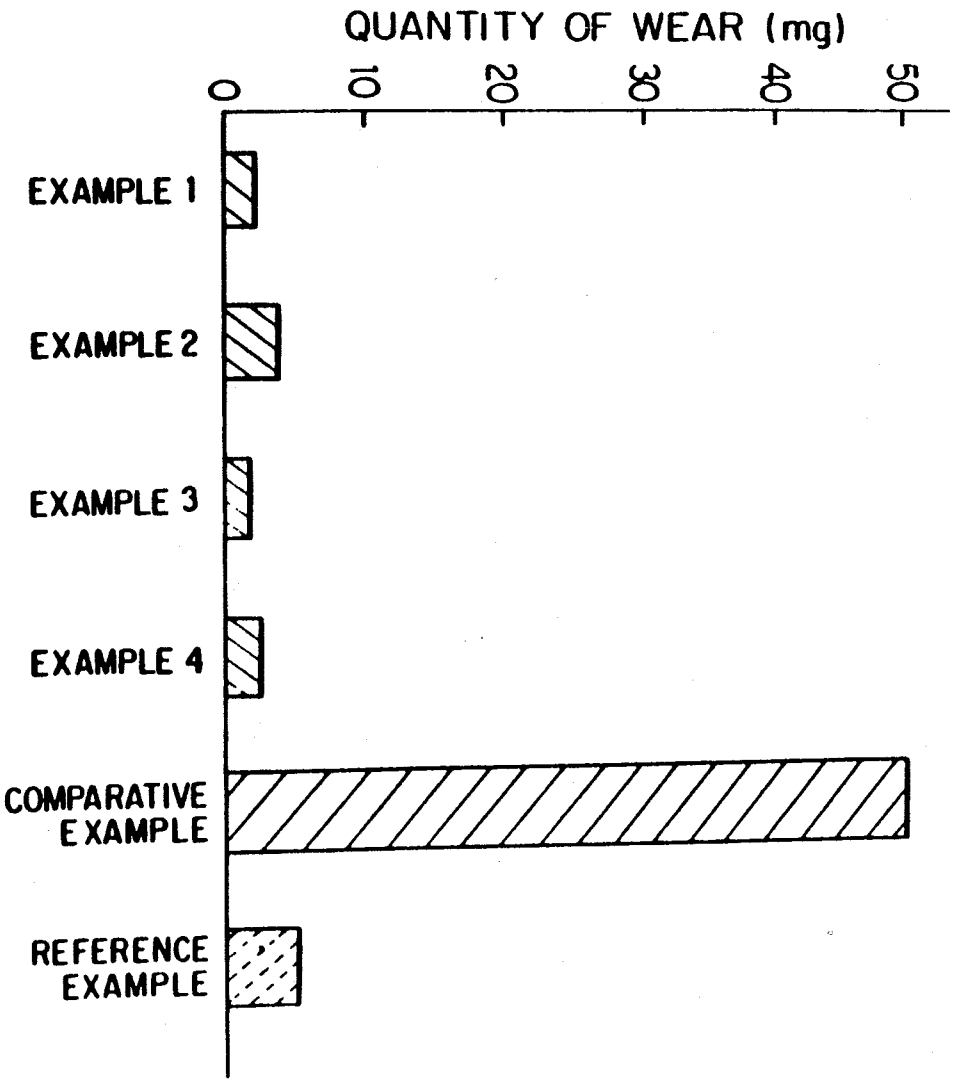
FIG. 9 is a graph which illustrates the quantity of wear of slidable members to be combined with each other, with respect to Examples 1 to 4, Comparative Examples 1 and 2 and the Reference Example.
Figure 10:
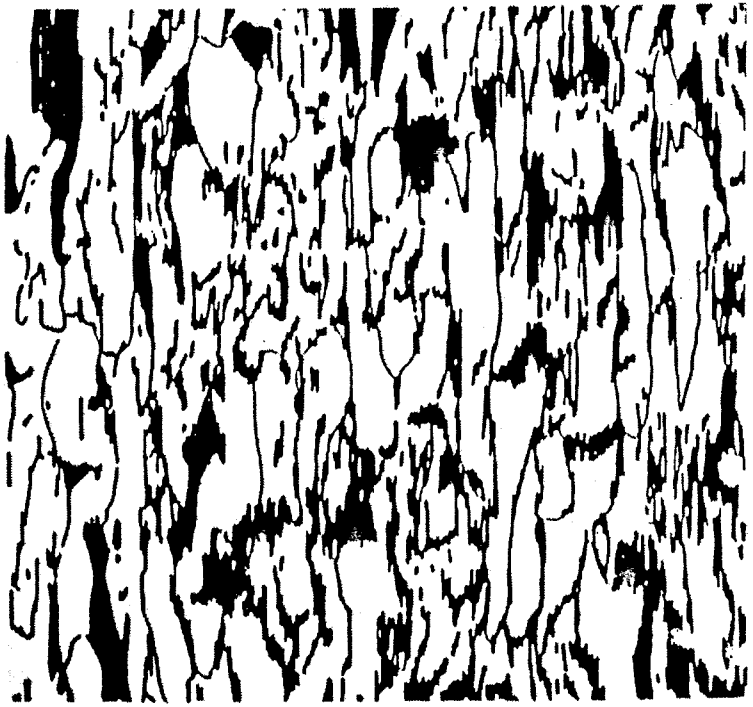
FIG. 10 is a microscopic photograph which illustrates a macrostructure of a cold-rolled ordinary carbon steel.

FIG. 9 is a graph which illustrates a quantity of wear of respective slidable members to be combined with each other, with respect to the Examples 1 to 4, the Comparative Examples 1 and 2 and the Reference Example. As is apparent from FIG. 9, as far as the CFC 12 is used as the refrigerant, there does not arise any problem even when slidable members each having a Vickers hardness in excess of 300 are employed. However, when a refrigerant containing no chlorine atom is used to be substituted for the CFC 12, wear resistance of each of the conventional slidable members is largely degraded as described above in the Example 1. This leads to the necessity for arranging a slidable member suitably employable for with HFC 134a and HFC 152a each containing no chlorine atom. In contrast with this, according to the present invention, since a cast iron and a carbon steel are combined with each other while a Vickers hardness, the number of crystalline grains and a crystal form are properly controlled with respect to each of them, it becomes possible to improve wear resistance of each slidable member to an extent equal to the conventional refrigerating system having the CFC 12 used as the refrigerant or to an extent much more than the same.

While the present invention has been described above with respect to the rotary type refrigerant compressor, it should of course be understood that the present invention should not be limited only to this but various changes or modifications may be made without departure from the scope of the invention as defined by the appended claims. For example, the present invention may equally be applied to a reciprocating-type refrigerant compressor with excellent wear resistance while slidable members are combined with each other in the above-described manner.

What is claimed as new and desired to be Secured by Letters Patent of the United States is:

1. A refrigerant compressor in which 1,1,1,2-tetrafluoroethane or 1,1-difluoroethane is used as the refrigerant, comprising:

a closed casing in which said refrigerant and a refrigerator oil having compatibility with said refrigerant are received, a compressing mechanism including a slidable section constructed by combining a first slidable member made of a cast iron having a Vickers hardness within the range of 200 to 300 with a second slidable member made of a carbon steel having a Vickers hardness within the range of 200 to 300 and an average number of crystalline grains per 1 $mm^2$ within the range of 2000 to 3200, said compressing mechanism being accommodated in said closed casing, and a motor mechanism for driving said compressing mechanism.

2. The refrigerant compressor as claimed in claim 1, wherein said slidable section includes a shaft for transmitting to said compressing mechanism a driving force generated by said motor mechanism and a bearing for rotatably supporting said shaft.

3. The refrigerant compressor as claimed in claim 2, wherein said shaft is constituted by said first slidable member and said bearing is constituted by said second slidable member.

4. The refrigerant compressor as claimed in claim 1, wherein said refrigerator oil includes at least one kind of oil selected from an ether-based oil, an ester-based oil and a fluorine-based oil.

5. The refrigerant compressor as claimed in claim 1, wherein said carbon steel includes crystalline grains each having a substantially isotropic shape.

6. The refrigerant compressor as claimed in claim 1, wherein said slidable section includes a cylinder and a movable member for compressing said refrigerant while coming in slidable contact with the inner wall surface of said cylinder.

7. The refrigerant compressor as claimed in claim 6, wherein said cylinder is constituted by said first slidable member and said movable member is constituted by said second slidable member.

* * * * *